United States Patent [19]

Hart

[11] 4,351,484

[45] Sep. 28, 1982

[54] METHOD OF GRINDING MAGNESIUM INGOTS AND SUCH INGOTS

[76] Inventor: Robert J. Hart, 190 Briar Wood Crossing, Lawrence, N.Y. 11559

[21] Appl. No.: 924,956

[22] Filed: Jul. 17, 1978

Related U.S. Application Data

[63] Continuation-in-part of Ser. No. 840,811, Oct. 11, 1977, abandoned, which is a continuation of Ser. No. 717,540, Aug. 25, 1976, abandoned.

[51] Int. Cl.[3] ..... B02C 19/12

[52] U.S. Cl. ..... 241/30; 241/277; 241/280

[58] Field of Search ..... 241/27, 30, 277, 280–282; 29/527.6, DIG. 19, DIG. 27, DIG. 67; 264/111; 403/334, 364, 375; 425/113, 114, 380; 428/33, 573, 582, 585

[56] References Cited

U.S. PATENT DOCUMENTS

| | | | |
|---|---|---|---|
| 3,211,390 | 10/1965 | Dugle et al. | 241/280 |
| 3,373,308 | 3/1968 | Perrin | 403/334 X |
| 3,901,662 | 8/1975 | Chernichenko et al. | 428/582 |

*Primary Examiner*—Mark Rosenbaum
*Attorney, Agent, or Firm*—Hubbell, Cohen, Stiefel & Gross

[57] ABSTRACT

A method of grinding metallic ingots into small chips or powder, which comprises the steps of providing a cutting element including a plurality of teeth, providing a plurality of ingots, each comprising a main body having a lower surface, a front end and a rear end, the rear end having an outwardly extending projection and the front end having a corresponding recess at least partially defined by a lower surface, the lower defining surface of the recess having an angle $\alpha$ associated therewith where $0° < \alpha \leqq 90°$; arranging the ingots in end-to-end relation with the projection of each ingot in the corresponding recess of the next; and disposing the lower surfaces of the ingots on a guideway and feeding the ingots, front ends first, along the guideway into the cutting element to effect grinding without waste or damage to any of the grinding apparatus. An ingot configuration for practicing the method is also disclosed.

8 Claims, 9 Drawing Figures

METHOD OF GRINDING MAGNESIUM INGOTS AND SUCH INGOTS

CROSS-REFERENCE TO RELATED APPLICATIONS

This application is a continuation-in-part of my U.S. application Ser. No. 840,811, filed Oct. 11, 1977, entitled A Method of Grinding Magnesium Ingots and Such Ingots, which is, in turn, a continuation application of U.S. application Ser. No. 717,540, filed Aug. 25, 1976 bearing the same title, now both abandoned.

BACKGROUND OF THE INVENTION

1. Field of the Invention

This invention pertains to a method of machining magnesium or other metal ingots into finely divided particulate form, and more particularly to a method of grinding successive magnesium ingots into small chips or powders without any damage to any of the grinding apparatus and without material waste. This invention also pertains to the configuration of the metal ingots used in practicing the method.

2. Statement of the Prior Art

It has been customary, when reducing magnesium or magnesium-base metals into powdered form by machining (such as disclosed in Leontis et al U.S. Pat. No. 2,657,796), to initially supply the metal in the form of ingots which are first ground into small chips by a suitable grinding machine, such as a cutter wheel. These chips may then be fed through a hammer mill where they are further reduced to powdered form. It has been found, however, that as the ingots are fed into the cutter wheel the last portion of the ingot, commonly referred to as the butt end, has a tendency to be bounced around or vibrated by the action of the cutting teeth on the cutter wheel. When subjected to such vibrations the ingot butt end sometimes slips past the cutter teeth and is removed from the grinding mechanism together with the other chips. Consequently, when the chips are fed through a hammer mill, a screen having a rather large mesh size must be employed so that any butt ends which have slipped through the initial grinder do not damage the hammer mill screen. Inasmuch as the size of the mesh is directly related to the relative fineness of the magnesium or magnesium alloy powder produced in the hammer mill, these prior art methods have only been capable of producing relatively coarse products.

Accordingly, when it is desired to reduce the magnesium to a relatively fine powdered form, it is desirable that only small magnesium chips be fed into the hammer mill in order that a screen having a relatively small mesh size may be employed therein.

One solution to this problem has been to secure the butt end of the magnesium ingot in a suitable clamping element, and then use such element to control the movement of the ingot as it is fed into the cutter wheel. However, this practice is disadvantageous in that the butt end thus clamped, which can represent as much as 5–10 percent by weight of the magnesium ingot, cannot be ground into chips without additional processing, and it is therefore normally discarded.

Another solution suggested by Dugle et al, U.S. Pat. No. 3,211,390, has been to employ ingots having a V-shaped groove at one end and a correspondingly tapered point at the other. These ingots are disposed in end-to-end relation with the tapered point of one ingot in the groove of the next and then fed into the cutting element. In conjunction with this arrangement, Dugle et al uses a plurality of spring biased guiding dogs which, together with the V-shaped groove in the front end of the succeeding ingot, serve to hold the butt end of the ingot being ground in the path of the cutter wheel. However, and as conceded by Dugle et al in their patent, even this arrangement is insufficient to accomplish complete grinding of the butt end and, therefore, Dugle et al provide a screen or trap to receive the unground butt end portions which drop out of the path of the cutter wheel. Thus, as in the case with the clamping arrangement described above, the pointed ends cannot be ground into chips without additional processing.

Accordingly, it is an object of the present invention to provide a method of grinding magnesium ingots or the like into finely divided particulate form, without any waste.

A further object of the invention is to provide a method of grinding the butt ends of magnesium ingots into small chips or powder without special processing.

A still further object of the invention is to provide an ingot having a construction particularly suited to facilitate the improved processing of the present invention.

Applicant also wishes to make of record U.S. Pat. Nos. 3,219,283, 3,373,308 and 2,279,602.

SUMMARY OF THE INVENTION

The present invention pertains to a method of grinding a plurality of metallic, e.g., magnesium or magnesium-base alloy, ingots into small chips or powders without waste. According to the preferred method, this is accomplished by providing one end of each ingot with an integral wedge-shaped projection and the other end of each ingot with a corresponding recess or groove such that the ingots may be aligned in end-to-end relation with the projection of one ingot engaging the corresponding recess of an adjacent ingot. The thus engaged ingots are then fed, as by a guideway, recessed ends first, into a grinding apparatus which reduces the ingots into finely divided form.

The projection and corresponding recesses are configured such that each projection will be held in its mating recess throughout the cutting operation. Thus, the ingot recesses preferably have horizontal lower defining surfaces. The projections are dimensioned for a close mating fit with the recesses. This insures that as each ingot is ground until only its butt end remains, the tendency of that butt end to slide out ot its mating recess under the influence of gravity is avoided. While this may also be accomplished by sloping the lower defining surfaces of the recesses downwardly from the front ends of the ingots to their rear ends, horizontal surfaces are preferred as this had been found to facilitate manufacture and use. In a preferred embodiment, each recess is partially defined by an upper surface which overhangs the lower defining surface whereby the ingot recesses and projections take on a wedge-shaped appearance. This configuration is desirable as it serves to reduce relative vertical movement, commonly termed "chatter", between the butt end of the ingot being ground and the next ingot. Consequently, the butt end is more securely held in the recess of the next ingot to be ground into finely divided form along with that ingot. It will therefore be apparent that the ingot arrangement of the invention accommodates more complete ingot grinding without additional equipment or processing.

Further features and advantages of the method and ingot configuration according to the present invention will become apparent from the following detailed description and annexed drawings which disclose certain non-limiting examples of preferred embodiments thereof.

DETAILED DESCRIPTION OF THE PREFERRED EMBODIMENTS

Figure 1:
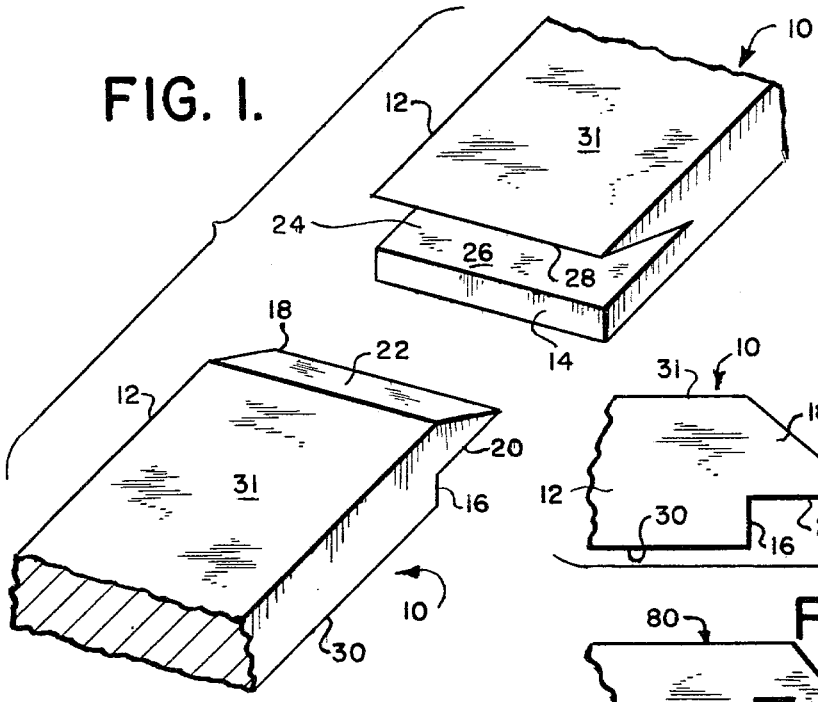
FIG. 1 is a perspective view showing the rear portion of one ingot and the front portion of a second ingot to be ground into finely divided form in accordance with the present invention.
Figure 2:
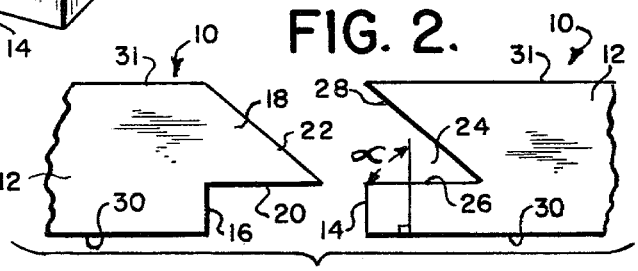
FIG. 2 is an elevational view of the ingot portions shown in FIG. 1.
Figure 3:
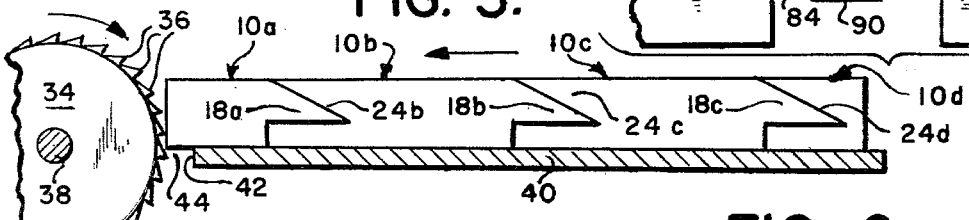
FIG. 3 is an elevational view, partly in section, of a plurality of ingots of the type illustrated in FIGS. 1 and 2 arranged in interlocking relation and being fed into a grinding wheel.

With reference now to the drawings in detail and initially to FIGS. 1–3 thereof, a plurality of magnesium or similar ingots to be ground into particulate form are generally designated at 10. As shown, each of the ingots 10 has a body 12, a front end 14 and a rear or butt end 16. While ingots 10 having generally rectangular cross-sections are presently preferred and shown in FIG. 1, it will be apparent hereinafter that ingots having other cross-sections may also be advantageously employed.

The butt end 16 of each of the ingots 10 has an integral outwardy projecting element formed thereon, while the front end 14 of each of the ingots is provided with a corresponding indentation in which the integral projection of an adjacent ingot 10 may be received and engaged. In the ingot embodiment illustrated in FIGS. 1–3, the integral element is a wedge-shaped projection 18 having a lower surface 20 and an upper surface 22 and the indentation is a corresponding recess or groove 24 having a lower defining surface 26 and an upper defining surface 28. As presently preferred and shown, the surfaces 20 and 26 are parallel to the lower surface 30 of the ingots 10, although as will be apparent hereinafter, this is not mandatory. Similarly, while it is preferred and shown that the surfaces 22 and 28 terminate at the upper surface 31 of the ingot 10, it will be apparent hereinafter that this too is not necessary.

With particular reference to FIG. 3, the ingots 10 are arranged in juxtaposed end-to-end fashion such that the front ends 14 and butt ends 16 of the successive ingots 10 are in confronting relation, with the successive projections 18 and recesses 24 mating with and engaging one another. Thus, and as shown, the projection **18*a* of the first ingot 10*a* is engaged with the recess 24*b* of a second ingot 10*b*, the projection 18*b* of the second ingot 10*b* engages the recess 24*c* of a third ingot 10*c***, and so on.

The ingots **10*a*, 10*b*, 10*c*, etc. are then sequentially fed, front ends first, into a conventional grinding apparatus. As presently preferred and shown, the grinding apparatus comprises a generally cylindrically shaped cutting element 34 having a plurality of teeth 36 distributed over the outwardly facing cylindrical surface thereof. Those skilled in the art will recognize that other grinding apparatus, such as a cutting wheel having a plurality of teeth distributed over one face thereof may also be employed. As the ingots 10 are fed into the cutter wheel 34, the wheel 34 is rotated as by a shaft 38, the teeth 36 serving to grind the ingots 10*a*, 10*b*, 10*c*, etc. into chips. As shown in the drawing, the sequentially fed ingots 10*a*, 10*b*, 10*c*, etc. may be fed into the cutter wheel 34 along a track or guideway 40 although any of numerous other means well known to persons skilled in the art may be employed for this purpose. As presently preferred and best shown in FIG. 3, the guideway is positioned relative to the cutting element 34 such that the axis of the cutting element 34 lies in the plane defined by the upper surface of the guideway 40. The space 44 between the cutting element 34 and the confronting edge 42 of the guideway is minimal and will typically be about 0.005 to 0.010 inches. When the ingots are fed from the right as shown in FIG. 3, the cutting element 34 is preferably rotated in a clockwise direction. The purpose is to have the cutting teeth 36 cut down through the ingots 10 for holding them against the guideway 40. This arrangement has also been found to facilitate stoppage of the ingot feed without necessitating realignment of the ingots 10 relative to the cutting element 34. Thus, as will be apparent from FIG. 3, when rotated in a clockwise direction, the tendency of the cutting element 34 is to push the ingots 10 to the right away from the cutting element. Thus, when the force applied to the ingots 10 to feed them into the elements 34 is discontinued, the teeth 36 will push the ingots 10** slightly backwards whereupon they come to rest properly oriented for continuation of the process.

According to the preferred embodiment of the invention, and as best shown in FIG. 2, the lower surfaces 20 and 26 of the projection 18 and recess 24, respectively are horizontally oriented. By horizontally orienting the lower surfaces 20 and 26 of the projection 18 and recess 24, respectively, the possibility that the butt ends of the ingots will slip out of their mating recesses under the influence of gravity and thus escape unground through the space 44 is avoided. While this may also be accomplished by sloping the surfaces 20 and 26 downwardly from the front ends 14 of the ingots 10 to their rear ends 16, horizontal surfaces are presently preferred as this has been found to facilitate both manufacture and use. Thus, while the lower defining surface 26 of the recess 24 preferably defines an angle $\alpha=90°$ with a plane extending through the ingot 10 perpendicular to the lower surface 30 thereof, it should be recognized that other values of $\alpha$ as defined by the following expression may be selected: $0° < \alpha \leqq 90°$.

Figure 4A:
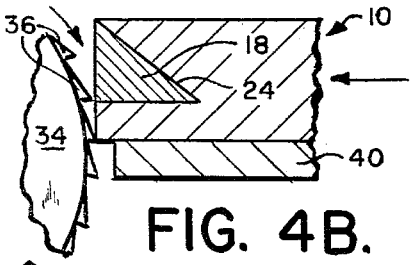
FIGS. 4A, B and C are fragmentary elevational views, partly in section showing, in successive stages, the front end of one ingot as it is ground into powdered form along with the butt end of the preceding ingot.
Figure 4B:
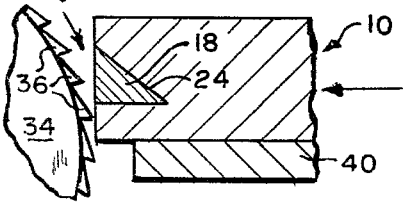

In the preferred ingot configuration, the recesses 24 and the corresponding projections 18 are wedge-shaped. Thus, and as best shown in FIGS. 2, 3 and 4, each recess has an upper defining surface 28 which overhangs the lower defining surface 26. When the ingots are in end to end relation, the surfaces 28 mate with upper surfaces 22 of the projections 18 which, as noted above, are also wedge-shaped.

Figure 4C:
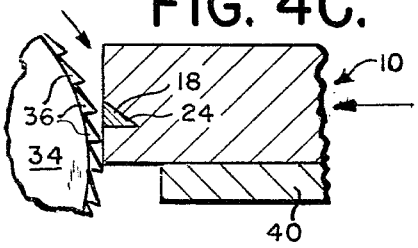

This configuration is desirable since it serves to prevent relative vertical displacement, i.e. chatter, between the projections and recesses due to the action of the cutter wheel 34. Thus, and as best shown in FIG. 4, as the front end 14 of the ingot 10 is processed by cutter wheel 34, the projection 18 is firmly held in the recess 24 even when only a small portion of the projection 18 remains (FIG. 4C). Consequently, the tendency of the projections 18 to become dislodged from the recesses 24 by the action of the teeth 36 is reduced.

It will be apparent from the foregoing that the ingot configuration and method according to the present invention insures that the ingots are substantially completely ground into small chips and does so without the need for additional equipment or processing.

Figure 5:
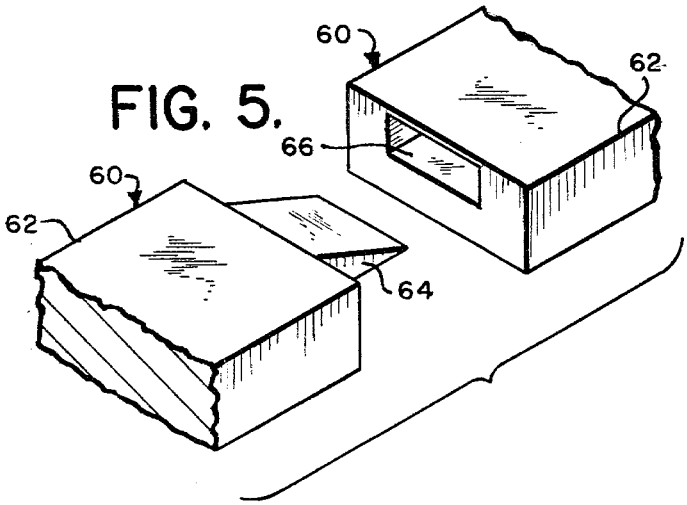
FIG. 5 is a view similar to FIG. 1 showing an alternative ingot embodiment.

In each of the embodiments thus far illustrated, the recess is so dimensioned that the projection is interlocked in the recess against vertical displacement therefrom, there normally being no appreciable tendency for the ingots to laterally disengage from each other. However, in the event it is desired to interlock the projection against both vertical and lateral motion within the recess, the ingot design shown in FIG. 5 may be employed wherein the width of the projection 64 is narrower than the body 62 of the ingot 60, the recess 66 being shaped to accommodate the projection 64.

Figure 6:
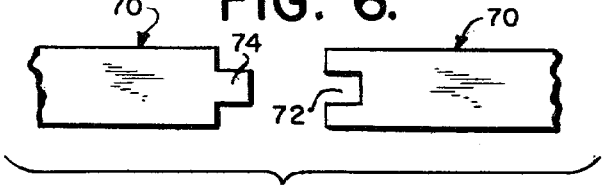
FIG. 6 is a view similar to FIG. 2 showing another alternative ingot embodiment.

Furthermore, while the projections 18 and recesses 24 have been shown and described as wedge-shaped, this too is not necessary and other shapes may be employed. For example, with reference to FIG. 6, ingots 70 having rectangular recesses 72 and corresponding projections 74 may be used.

Figure 7:
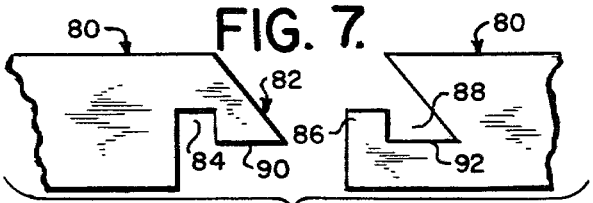
FIG. 7 is another view similar to FIG. 2 showing a still further alternative ingot embodiment.

The still further ingot configuration illustrated in FIG. 7 is designed to prevent disengagement of the ingots 80 once they have been interlocked. The embodiment illustrated in FIG. 7 is similar to the preferred embodiment of FIGS. 1–4 save for the fact that the projection 82 of the ingot 80 is provided with an identation 84. Indentation 84 mates with a corresponding protuberance 86 on the lower surface of the recess 88 of the succeeding ingot. Once the ingots 80 are interlocked, it will be clear that seating of the protuberance 86 in the indentation 84 substantially reduces the possibility of disengagement. Of course, once the protuberance 86 is ground away by the cutting mechanism, the remaining portion of the protrusion 82 will be seated in the recess 88 in much the same manner as the projections 18 of the ingots 10 of FIG. 1 are seated in their corresponding recesses 24. Thus, once again it is essential that the lower surfaces 90 and 92 of the projection 82 and recess 88, respectively, meet the requirement that $0° < \alpha \leqq 90°$.

Skilled art workers will recognize that the projections and recesses of the ingots may take on still other shapes and that the actual dimensions of the projections 18 and recesses 24 of the ingots will depend on the overall size of the ingots.

However, whatever their shape, and as is the case with all of the other ingot embodiments described herein, the lower defining surface of the recess must be oriented to prevent displacement of the mating projection under the influence of gravity.

Since these and other changes and modifications are within the scope of the present invention, the above description should be construed as illustrative and not in the limiting sense, the scope of the invention being defined by the following claims.

What is claimed is:

1. A method of grinding metallic ingots into finely divided form, comprising:

(a) providing a cutting element including a plurality of teeth;

(b) providing a plurality of ingots, each of said ingots comprising a main body having a lower surface, a front end and a rear end, said rear end having an outwardly extending projection and said front end having a corresponding recess at least partially defined by a lower surface, said lower defining surface of said recess defining a plane having an angle $\alpha$ associated therewith relative to a plane extending through the ingot perpendicular to the lower surface thereof, $\alpha$ being selected such that $0° < \alpha \leqq 90°$;

(c) arranging the ingots in end-to-end relation with the projection of each ingot in the corresponding recess of the next ingot; and (d) disposing the lower surfaces of the ingots on a guideway and feeding the ingots, front ends first, along the guideway into the cutting element to sequentially grind each ingot, including the projection thereof, into finely divided form.

2. The method of claim 1, wherein said ingot projections and corresponding recesses are wedge-shaped and $\alpha = 90°$.

3. The method of claim 1, wherein said ingot projections and corresponding recesses are narrower than the width of the main bodies of the ingots.

4. The method of claim 3, wherein said ingot projections and corresponding recesses are rectangular.

5. In a method of machining metallic ingots into fine powdered form of the type which comprises feeding successive ingots into a cutting element to grind the ingots into small chips, and feeding the resulting chips into a hammer mill to reduce them into fine powdered form, the improvement comprising:

(a) providing said cutting element with a plurality of teeth;

(b) providing a plurality of ingots, each of said ingots comprising a main body having a lower surface, a front end and a rear end, said rear end having an outwardly extending projection and said front end having a corresponding recess, said recess being at least partially defined by a lower surface, said lower defining surface of said recess defining a plane having an angle $\alpha$ associated therewith relative to a plane extending through the ingot perpendicular to the lower surface thereof, $\alpha$ being selected such that $0° < \alpha \leqq 90°$;

(c) arranging the ingots in end-to-end relation with the projection of each ingot in the corresponding recess of the next ingot; and (d) disposing the lower surfaces of the ingots on a guideway and feeding the ingots, first ends first, along the guideway into the cutting element to sequentially grind each ingot, including the projection thereof, into the small chips to be fed into the hammer mill to thereby reduce the ingots to fine powdered form without damage to the hammer mill.

6. The method of claim 5, wherein said ingot projections and corresponding recesses are wedge-shaped and $\alpha = 90°$.

7. The method of claim 5, wherein said ingot projections and corresponding recesses are narrower than the widths of the main bodies of the ingots.

8. The method of claim 5, wherein said ingot projections and corresponding recesses are rectangular.

* * * * *